US010525569B2

(12) United States Patent
Linde

(10) Patent No.: US 10,525,569 B2
(45) Date of Patent: Jan. 7, 2020

(54) WATER-ABRASIVE CUTTING SYSTEM

(71) Applicant: ANT Applied New Technologies AG, Lübeck (DE)

(72) Inventor: Marco Linde, Lübeck (DE)

(73) Assignee: ANT Applied New Technologies AG, Lübeck (DE)

( * ) Notice: Subject to any disclaimer, the term of this patent is extended or adjusted under 35 U.S.C. 154(b) by 14 days.

(21) Appl. No.: 15/551,755

(22) PCT Filed: Feb. 18, 2015

(86) PCT No.: PCT/EP2015/053432
§ 371 (c)(1),
(2) Date: Aug. 17, 2017

(87) PCT Pub. No.: WO2016/131483
PCT Pub. Date: Aug. 25, 2016

(65) Prior Publication Data

US 2018/0021922 A1 Jan. 25, 2018

(51) Int. Cl.

| | |
|---|---|
| ***B24C 1/04*** | (2006.01) |
| ***B24C 3/32*** | (2006.01) |
| ***E21B 29/00*** | (2006.01) |
| ***B24C 9/00*** | (2006.01) |

(52) U.S. Cl.
CPC ..... *B24C 1/045* (2013.01); *B24C 3/32* (2013.01); *B24C 3/325* (2013.01); *B24C 9/00* (2013.01); *E21B 29/00* (2013.01); *E21B 29/002* (2013.01); *E21B 29/005* (2013.01)

(58) Field of Classification Search
CPC ..... B24C 1/045; B24C 3/32; B24C 3/325; B24C 9/00; E21B 29/00; E21B 29/002; E21B 29/005; E21B 29/08
USPC ..... 451/2, 76, 102; 166/55.7, 55.8, 298
See application file for complete search history.

(56) References Cited

U.S. PATENT DOCUMENTS

| | | | | |
|---|---|---|---|---|
| 2,315,496 A * | 4/1943 | Boynton | ..... | E21B 43/114 166/222 |
| 3,081,828 A * | 3/1963 | Quick | ..... | E21B 29/00 166/55 |
| 3,393,736 A * | 7/1968 | Goodwin | ..... | E21B 41/0078 166/276 |
| 4,047,569 A * | 9/1977 | Tagirov | ..... | E21B 41/0078 166/222 |

(Continued)

FOREIGN PATENT DOCUMENTS

| | | |
|---|---|---|
| DE | 10 2011 052 399 A1 | 2/2013 |
| EP | 0 984 265 A2 | 3/2000 |

(Continued)

*Primary Examiner* — Eileen P Morgan
(74) *Attorney, Agent, or Firm* — McGlew and Tuttle, P.C.

(57) ABSTRACT

A water-abrasive cutting system includes a cutting head (2) which includes a fixing device (16, 18, 20) for fixing the cutting head (2) on the wall to be cut as well as a nozzle head (10) disposed on the cutting head (2). At least one cutting nozzle (12), for an application of a cutting jet (14), is disposed in the cutting head (2). A cutting monitoring device (26) includes at least one hydrophone (30) and at least one further sensor. The cutting monitoring device (26) is configured to detect a complete penetration and/or cutting-through of the wall on the basis of the sensor signals of the hydrophone (30) and the at least one further sensor.

19 Claims, 3 Drawing Sheets

(56) References Cited

U.S. PATENT DOCUMENTS 4,768,899 A * 9/1988 Dysarz ..... E02D 9/04 166/55
5,001,870 A * 3/1991 Yokota ..... B24C 1/045 29/426.3
5,010,694 A * 4/1991 Agbede ..... B24C 1/045 299/17
5,381,631 A * 1/1995 Raghavan ..... B24C 1/045 166/298
5,791,417 A * 8/1998 Haugen ..... E21B 7/061 166/117.6
6,155,343 A * 12/2000 Nazzal ..... E21B 29/00 166/222
6,564,868 B1 * 5/2003 Ferguson ..... B23D 21/14 166/222
7,140,429 B2 * 11/2006 Grebennikov ..... E21B 43/114 166/55
7,152,679 B2 * 12/2006 Simpson ..... E21B 23/04 166/297
7,178,598 B2 * 2/2007 Lund ..... E02D 9/005 166/298
7,434,633 B2 * 10/2008 Lynde ..... E21B 29/005 166/55.8
7,540,327 B2 * 6/2009 Billingham ..... E21B 41/00 166/223
8,820,396 B2 * 9/2014 Cumby ..... E21B 29/005 166/55
9,097,092 B2 * 8/2015 Gillan ..... E21B 33/12
9,228,422 B2 * 1/2016 Watson ..... E21B 29/002
9,416,636 B2 * 8/2016 Myhre ..... E21B 29/06
9,464,399 B2 * 10/2016 Melancon ..... B24C 1/045
9,670,734 B2 * 6/2017 Surjaatmadja ..... E21B 29/005
9,677,362 B2 * 6/2017 Surjaatmadja ..... E21B 29/005
2007/0175636 A1 * 8/2007 McAfee ..... E21B 7/18 166/297
2009/0314489 A1 * 12/2009 Guigne ..... E21B 29/002 166/250.01
2014/0157963 A1 * 6/2014 Von Wirth ..... E02D 9/04 83/27
2015/0122501 A1 * 5/2015 Babbitt ..... E21B 29/12 166/339
2015/0211202 A1 * 7/2015 Melancon ..... E02D 9/04 451/76
2015/0337634 A1 * 11/2015 O'Leary ..... E21B 43/114 166/298

FOREIGN PATENT DOCUMENTS

EP 2 617 540 A1 7/2013
EP 2 746 005 A1 6/2014

* cited by examiner

WATER-ABRASIVE CUTTING SYSTEM

CROSS REFERENCE TO RELATED APPLICATIONS

This application is a United States National Phase Application of International Application PCT/EP2015/053432, filed Feb. 18, 2015, the entire contents of which are incorporated herein by reference.

FIELD OF THE INVENTION

The invention relates to a water-abrasive cutting system, for cutting pipes, having a cutting head which comprises a fixing device for fixing the cutting head on the wall to be cut as well as a nozzle head disposed on the cutting head, in which at least one cutting nozzle for application of a cutting jet is disposed.

BACKGROUND OF THE INVENTION

Water-abrasive cutting systems are used for the cutting of various materials and objects. For example, they are used for cutting pipes, in order, for example to cut oil carrying pipes under the seabed. Such cutting systems can however also be used for cutting pipes in other applications, for example, refineries, well building etc. Furthermore, not only pipes but also objects having different geometries can be cut with these systems. For cutting pipes a cutting head which is connected via a hose to a high-pressure pump and an abrasive agent mixing unit, is inserted into the inside of the pipe as far as the height of the cut to be made. There the cutting device is then fixed with a fixing device inside the pipe and the pipe wall is cut through from inside using a high-pressure water jet to which abrasive agent is added. A problem with these cuts is that the work must be carried out without visual monitoring and therefore it is difficult to detect whether the pipe wall has been completely cut through this means in the radial direction and is completely cut through over the entire circumference. This is particularly difficult to detect since these pipes are usually configured as multi-shell, comprising a plurality of metal pipes lying inside one another, where the intermediate spaces of the metal pipes are filled with concrete. At the same time however the pipes are not always arranged in a centered manner and the intermediate spaces are not always completely filled so that no uniform cutting conditions are given.

An apparatus for cutting through pipes under water is known, for example, from DE 10 2011 052 399 A1. In this system it is provided to use a sensor, preferably a hydrophone, with the aid of which the passage of the water jet through the pipe wall is detected. In particular in the multi-shell pipes described however, a reliable detection of the cutting-through is not always ensured, which is in particular attributable to the fact that the filling of the intermediate spaces between the individual pipes and also the material which surrounds the pipe on the outer side is not known and depending on these states, different noises can be detected which do not always indicate a complete cutting-through of the pipe wall.

SUMMARY OF THE INVENTION

In view of this prior art, it is the object of the invention to improve a water-abrasive cutting system for cutting pipes in such a manner that a more reliable detection of the cutting-through of the pipe wall is achieved. This object is solved by a water-abrasive cutting system according to the invention.

The water-abrasive cutting system according to the invention is used for cutting a wall of a fundamentally arbitrary object, but in particular for cutting pipes, where the cutting can be accomplished from inside or from outside. Particularly preferably the cutting is accomplished from inside the pipe. The water-abrasive cutting system according to the invention comprises in a known manner a high-pressure pump which provides water at high pressure. Furthermore, an abrasive agent supply is provided in order to mix the water at high pressure with abrasive agent. Preferably the system is configured as a water-abrasive suspension cutting system in which the abrasive agent is mixed with the water in the high-pressure region upstream of an outlet nozzle. The water at high pressure is supplied to this cutting head via a pressure line which connects the high-pressure pump to the cutting head. The cutting head is preferably configured to be introduced into the interior of a pipe to be cut through and to be advanced as far as the position of the cut. Furthermore the cutting head is provided with a fixing device which enables a fixing, in particular a clamping or bracing on a wall to be cut and in particular in the interior of a pipe at the position of the cut to be made. A nozzle head is further provided on the cutting head, preferably movably, in particular rotatably, which has at least one cutting nozzle for application of a cutting jet. In this case, the nozzle head is preferably arranged so that the cutting nozzle is directed radially outwards so that a radial cut can be introduced into a pipe wall. As a result of the movability or rotatability of the cutting head, the cutting nozzle can be moved so that the cutting jet can be moved over the wall to be cut, in particular over the entire circumference of a pipe in order to cut through the pipe wall over the entire circumference in the radial direction. To this end, the nozzle head is preferably arranged rotatably about 360° on the cutting head. A suitable drive, for example, an electric-motor or hydraulic drive is provided for the rotation. The drive is further preferably configured so that it is adjustable in its rotational speed where in particular a position detection can also be provided. The cutting jet can thus be moved in a defined manner so that during the cutting process it is ensured that the cutting jet is only moved further when the pipe wall is completely cut through in the radial direction.

In order to be able to detect or record the complete penetration of the wall or the pipe wall and/or a complete cutting through or separation of a component, such as in particular a pipe, a cutting monitoring device is provided according to the invention. This is part of the water-abrasive cutting system and in particular part of a control device of the cutting system which controls the cutting process and in particular the movement of the cutting head. In particular a manual or automatic control of the advance or the rotation of the cutting head is possible with the aid of the cutting monitoring device. According to a particularly preferred embodiment of the invention, the advance or the rotation can be defined independently by the control unit in cooperation with the cutting monitoring device and optionally adapted so that the cutting speed is adapted to the type of material and the material thickness. Alternatively this can be accomplished manually. Thus, it is possible that the control device is configured in such a manner that it only moves or turns the cutting head if a complete penetration (piercing) of the wall or the pipe wall is detected by the cutting monitoring device. The cutting monitoring device preferably comprises an electronic evaluation device. This evaluation device can also be integrated in a control device for the entire cutting system. Furthermore the cutting monitoring device comprises at least one hydrophone and at least one further sensor. In this case the cutting monitoring device or its evaluation device is configured in such a manner that it can detect a complete penetration and/or cutting-through of the wall or pipe wall on the basis of the sensor signals of this at least one hydrophone and the at least one further sensor. To this end, the said sensors are connected to the cutting monitoring device or its evaluation device for data transmission. In particular a superposition or common evaluation of the sensor signals is provided so that the penetration or cutting-through of the wall is detected from a certain combination of sensor signals.

Particularly preferably the at least one further sensor is at least one acoustic emission sensor, at least one acceleration sensor and/or at least one pressure sensor. Further preferred is a combination of hydrophone, acoustic emission sensor, acceleration sensor as well as a pressure sensor. The cutting monitoring device or its evaluation device is preferably configured so that it detects a complete penetration and/or cutting-through of a wall or pipe wall on the basis of the sensor signals of the acoustic emission sensor, the acceleration sensor, the hydrophone and the pressure sensor. To this end all these sensors are connected to the cutting monitoring device or its evaluation device for data transmission. The use according to the invention of at least two, preferably four different sensors, namely particularly preferably the hydrophone, an acoustic emission sensor, an acceleration sensor and a pressure sensor allows a substantially more accurate detection of the penetration and cutting-through of the wall than would be possible using only a hydrophone, as a result of the simultaneous evaluation and comparison of different signals. It is thus possible to make defined settings in the evaluation device that the signals of different sensors must together have certain desired values or variations in order to detect a successful penetration or cutting-through of the wall.

The acceleration sensor and the acoustic emission sensor can particularly preferably be configured as an integrated sensor, that is as an integrated acoustic emission acceleration sensor. Such a sensor can detect both acoustic emission and also accelerations acting upon it.

Further preferably the acceleration sensor and the acoustic emission sensor are arranged on the cutting head in such a manner that they can be brought into a vibration-transmitting communication, preferably in direct contact with a wall or pipe wall to be cut. For this purpose the sensors can be arranged on a support, which is attached to the cutting head in such a manner that it can come in contact with the wall or pipe wall. The cutting head is preferably configured in such a manner that the acceleration sensor is held in firm contact on the wall during the cutting process. Thus, movements of the wall can be transmitted directly to the acceleration sensor and detected by this. As a result of the vibration-transmitting contact or the vibration-transmitting connection between the acoustic emission sensor and the wall, the acoustic emission sensor can detect acoustic emission or vibrations from the wall which change during penetration and cutting-through of the wall.

Further preferably the acceleration sensor and the acoustic emission sensor are disposed in a contact element of the fixing device which is provided for contact against the wall or pipe wall. This has the advantage that when fixing the cutting head in the pipe, these sensors automatically come to rest on the wall, that is preferably on the inner side of the pipe wall. The contact element of the fixing device is preferably pressed by suitable pressure or clamping means in the radial direction towards the inner wall of the pipe in order to thus brace the cutting head in the interior of the pipe. At the same time a secure contact of the acoustic emission and acceleration sensor on the pipe wall is then achieved in this case, thereby ensuring the described transmission of vibrations and motion. The acoustic emission sensor and/or the acceleration sensor can preferably be placed directly in a contact element which is connected to pressure and clamping means by which means this contact element can be moved towards the wall or pipe wall. Alternatively the said sensors can also be disposed in a fixed immovable contact element which can be brought into contact with the wall or pipe wall by moving another contact element connected to pressure or clamping means, which is located on a facing-away side of the cutting head. One configuration with such fixed contact elements is described further below.

The acceleration sensor is preferably a multi-axis acceleration sensor, in particular a 3D acceleration sensor. Thus, accelerations in various directions, preferably in all three spatial directions can be recorded.

The hydrophone is preferably disposed on an outer side of the cutting head in such a manner that it can come in contact with a liquid surrounding the cutting head. During the cutting process, for example, the interior of a pipe to be cut from inside fills with liquid, in particular with the water emerging from the cutting nozzle. Thus, the entire cutting head is placed in water during the cutting process. When the hydrophone is disposed in the manner described on the outer side of the cutting head, it can thus detect sound in this liquid, that is in the water. The noise occurring in the water varies in different operating states of the cutting system and in particular also during penetration (piercing) or cutting-through of the wall or pipe wall.

The pressure sensor is preferably disposed on the cutting head in such a manner that it can detect the pressure of a liquid surrounding the cutting head. This is, as described previously, preferably water. The pressure sensor comes in direct contact with the liquid or is in pressure-transmitting communication via a suitable line so that during the cutting process, e.g. the internal pressure of the liquid in the interior of the pipe can be detected.

According to a particularly preferred embodiment of the invention, the fixing device comprises several, preferably three contact elements distributed over the circumference of the cutting head, which can come in contact with a pipe wall for fixing. This configuration of the fixing device can be used independently of the previously described cutting monitoring device, that is even without this cutting monitoring device. This also applies to the details of the fixing device described hereinafter. As a result of the arrangement of a plurality of, preferably three contact elements, it is possible to brace the fixing device firmly in the interior of the pipe by pressing the contact elements in the radial direction towards the inner wall of the pipe. Furthermore, a positioning of the cutting head spaced apart from the inner wall of the pipe, in particular a centered arrangement is thus possible. Particularly preferably the plurality of contact elements, for example, the three said contact elements, are distributed uniformly over the circumference of the cutting head, thus a uniform transmission of force between cutting head and pipe wall is obtained. Furthermore the contact elements preferably lie in a cross-sectional plane normal to the longitudinal or advance axis of the cutting head. This longitudinal axis corresponds to the longitudinal axis of the pipe to be cut through.

Particularly preferably one of the contact elements is movable in the radial direction. To this end, for example, a hydraulic drive can be provided by which means the contact element can be moved radially outwards towards the inner wall of the pipe. Thus, a compressive force can be applied to the inner wall of the pipe in order to brace the cutting head in the interior of the pipe. Particularly preferably in the arrangement of a plurality of contact elements, only one of the contact elements is movable in the manner described. This simplifies the structure of the cutting head since merely one drive, in particular a hydraulic drive, must be provided for movement of a contact element. In such a configuration, possibly no precise centering of the cutting head in the interior of the pipe is possible. It has been shown however that this is not always necessary since the structure of the pipe walls, as described above, is usually not rotationally symmetrical in any case.

Further, preferably two of the contact elements are configured to be rigid in the radial direction and preferably are fastened exchangeably on the cutting head. This applies in particular when overall three contact elements are provided. In this configuration, preferably two contact elements are then configured to be rigid whilst the third contact element is movable radially in the previously described manner. As a result of the movement of the movable contact element, in this embodiment a bracing of the cutting head in the pipe is possible since the movable contact element is pressed against the inner wall of the pipe. As a reaction, the two rigid contact elements are pressed at the same time onto the pipe wall in the opposite direction. The rigid contact elements are preferably configured to be exchangeable. For this purpose contact elements having different radial length are provided so that it is possible to adapt the cutting head to different inside diameters of pipes. Thus, for larger pipe cross-sections in the radial direction, longer contact elements can be provided than for smaller pipe diameters. Thus, for different pipe diameters an approximate centering of the cutting head is always possible. Furthermore, the required stroke length of the movable contact element can be kept small.

According to a further preferred embodiment, the contact elements are configured to be sled-shaped, where the contact elements extend in their sled-shaped longitudinal extension parallel to the direction of advance of the cutting head in a pipe. Thus, the contact elements can guide the cutting head during insertion into a pipe in the interior of the pipe. A canting of the cutting head in the pipe during the advance is thus avoided.

According to a particular embodiment of the invention, at least one of the contact elements and preferably all the contact elements on a surface provided for contact on a pipe wall, that is the inner wall of the pipe, can comprise engagement means for positive engagement in the pipe wall. This can, for example, be a fluting or an arrangement of prongs which digs into the pipe wall and achieves a positive engagement in addition to the non-positive contact. A better fixing of the cutting head in the interior of the pipe can thereby be achieved.

The cutting monitoring device is further preferably configured in such a manner that it detects a cutting-through or separation of the wall, in particular of a separation of a pipe from an increase in the accelerations detected by the acceleration sensor. If, for example, the pipe is completely cut through or separated, and the cutting head with the acceleration sensor is preferably located in the upper part of the pipe, this separated pipe section can then move freely to a certain extent according to the surrounding material where these movements are then detected by the acceleration sensor. Such a movement is only possible when the pipe is completely cut through.

Further preferably the cutting monitoring device can be configured in such a manner that it detects that the cutting jet contains abrasive agent from a change in the sensor signal of the hydrophone. As a result a function control of the abrasive agent supply is possible. The noise occurring at the cutting nozzle varies depending on whether only water or water and abrasive agent emerges from the nozzle. Since the water-abrasive cutting system preferably comprises a suspension cutting system, in this the water with the abrasive agent is preferably discharged jointly from the cutting nozzle.

Further, the cutting monitoring device can preferably be configured in such a manner that it detects a piercing or penetration of a wall, e.g. of a pipe, from a reduction of the pressure detected by the pressure sensor and/or a change in the sensor signal of the acoustic emission sensor. The noise which occurs at the wall or pipe wall also changes when the wall is completely pierced. The pressure drop can occur as a result of the fact that the water discharged from the cutting nozzle can emerge radially outwards from the pipe to be cut from inside and no longer accumulates inside the pipe. However, each sensor alone cannot detect the complete piercing of the wall or pipe wall so that preferably the signals are evaluated in combination for which the cutting monitoring device or its evaluation device is configured accordingly. Thus, in a multi-shell pipe, for example, when no filling material is provided in the intermediate space between two pipes, a pressure drop can also occur without all the shells of the pipe being completely pierced.

According to a particularly preferred embodiment of the invention, the cutting monitoring device cooperates with a control device for controlling a drive of the nozzle head in such a manner that an advance movement of the nozzle head, i.e. in particular a turning movement of the nozzle head, is controlled manually or automatically as a function of a signal of the cutting monitoring device. In this case, the signal of the cutting monitoring device preferably represents a detected complete penetrating or piercing of the wall. The advance or turning movement of the nozzle head can thus be controlled so that the nozzle head is only moved further when the cutting jet has completely penetrated the wall. That is, the advance or turning movement is controlled or varied as a function of the cutting result so that a complete cutting-through of the wall is always achieved.

According to a further preferred embodiment, the cutting monitoring device is configured in such a manner that it has a training function. This training function enables the cutting monitoring device to adapt to different materials and environments. The training function is configured so that the cutting monitoring device is manually made aware of a complete cutting-through or penetration of the wall or pipe wall, whereupon the cutting monitoring device detects and stores the current sensor signals. That is, the cutting monitoring device learns how a complete penetration of the wall actually sounds. On the basis of the thus learnt sensor signals of the previously described various sensors, in particular the sensor signals occurring in combination, the cutting monitoring device can then identify the complete penetration or cutting-through of the pipe wall in the subsequent process sequence, i.e. during the further cutting process. The training can take place for example in such a manner that the nozzle head is held in a fixed position and then a cutting jet is applied for a certain time in which one can be certain that the pipe wall or wall must be completely cut through. This can be a time interval which has been determined experimentally in advance, for example, a time interval of 10 minutes. In this case, it should be understood that the standing still of the nozzle head involves a certain pendulum movement.

Insofar as the cutting system according to the invention has been described hereinbefore and hereinafter with reference to pipes, it should however be understood that also any other geometries can be cut in a corresponding manner, if the nozzle head is provided with a corresponding manipulation device. In the sense of the invention such other geometries should also be expressly covered by the description by reference to pipes.

The invention is described as an example hereinafter with reference to the appended figures.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
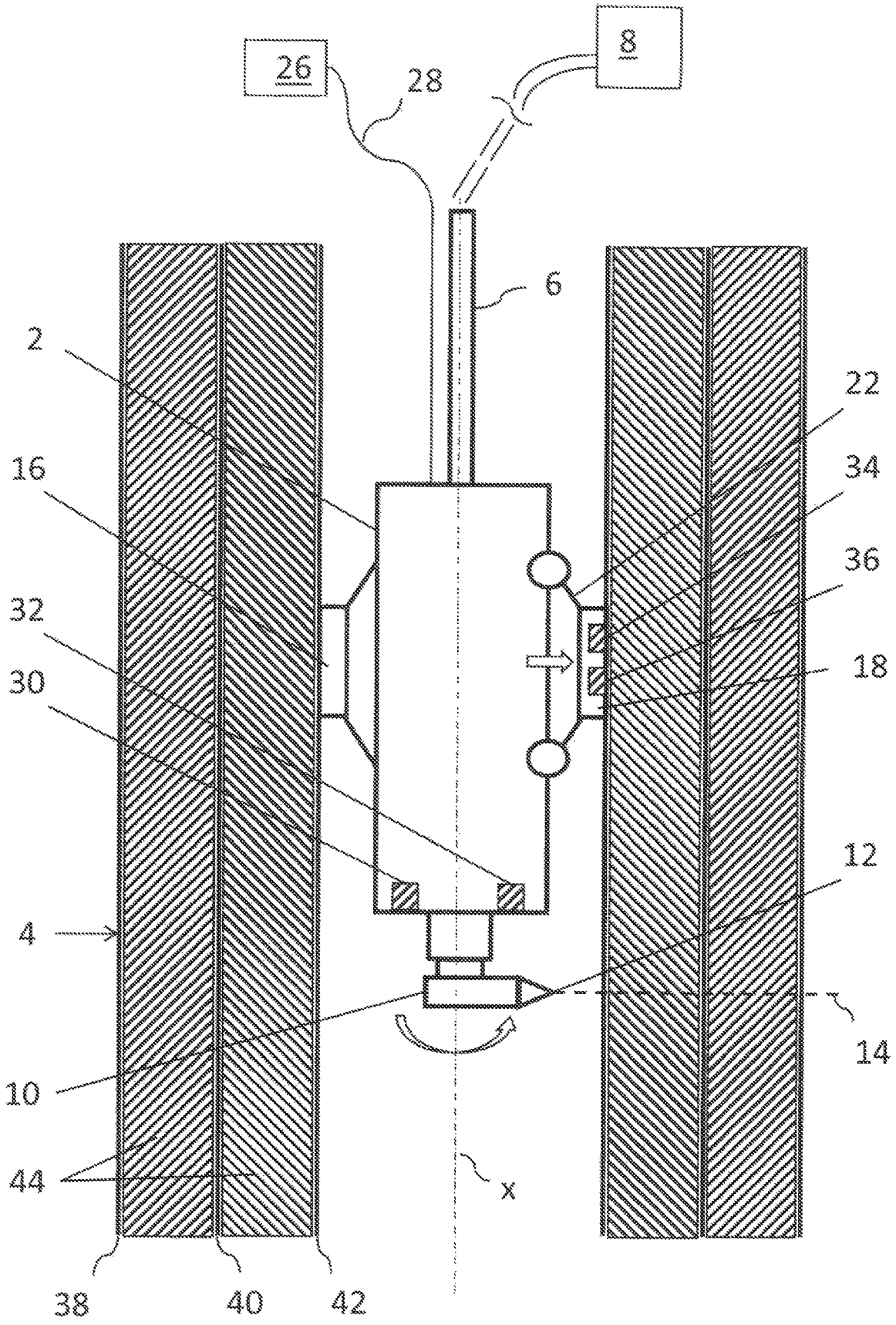
FIG. 1 is a sectional view of a pipe with a water-abrasive cutting system according to the invention.

Referring to the drawings, the shown water-abrasive cutting system is a water-abrasive suspension cutting system, that is a cutting system in which the abrasive agent is added to the water in the high-pressure region upstream of a cutting nozzle. The cutting system according to the invention comprises a cutting head 2 which is configured for insertion into a pipe 4. The cutting head 2 is connected via a pressure line 6 to a supply unit 8. The supply unit 8 comprises in particular a high-pressure pump which provides water at high pressure, for example, a pressure of 2500 bar or higher. Furthermore the supply unit 8 has an abrasive agent supply. The suspension at high pressure, that is a water-abrasive agent mixture, is supplied via the pressure line 6 to the cutting head 2. During operation the supply unit 8 remains outside the pipe. In offshore applications the supply unit 8 preferably remains above the water surface whilst the cutting head 2, for example, is introduced so far into an oil carrying pipe that it can make a cut below the seabed.

Figure 2:
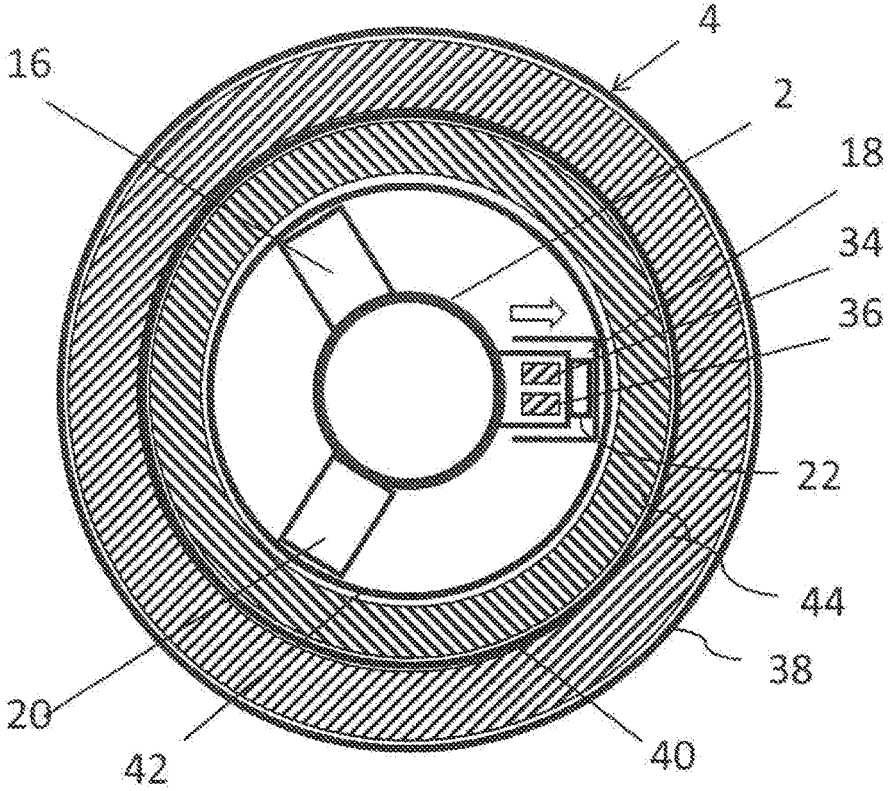
FIG. 2 is a cross-sectional view of the cutting head in the pipe according to a first embodiment of the invention.
Figure 3:
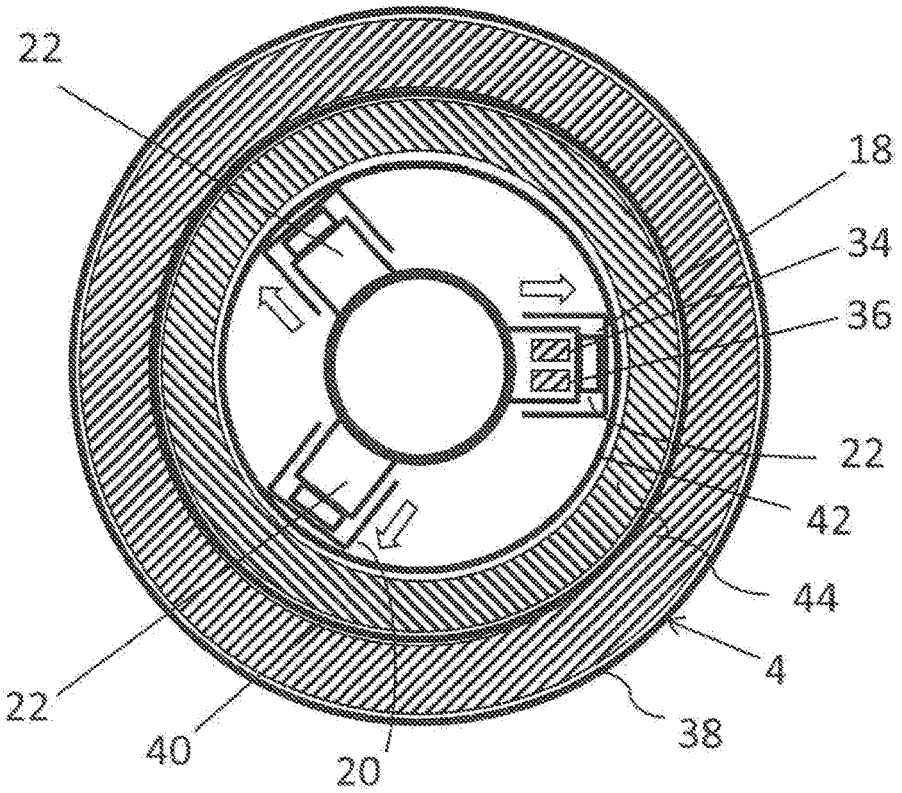
FIG. 3 is a cross-sectional view of the cutting head in the pipe according to a second embodiment of the invention.

At its front end in the insertion direction in which the cutting head 2 is inserted into the pipe 4, the cutting head 2 has a nozzle head 10 on which a radially directed cutting nozzle is disposed. A radially directed high-pressure cutting jet 14, that is a water-abrasive agent mixture, emerges from the cutting nozzle 12. The nozzle head 10 is rotatable with respect to the cutting head 2 about the longitudinal axis X of the cutting head 2 which corresponds to the longitudinal axis X of the pipe 4. For this purpose, a suitable drive not shown here in detail, for example, a hydraulic drive or an electrical drive, is provided in the cutting head 2. The cutting head 2 furthermore has a fixing device which enables it to be braced in the interior of the pipe 4. The fixing device has three contact elements 16, 18 and 20 in this case. The contact elements 16, 18 and 20 are configured in such a manner that they can come to rest non-positively and/or positively against the inner wall of the pipe 4 and thus brace and fix the cutting head 2 in the pipe 4. In the exemplary embodiment shown in FIGS. 1 and 2, for this purpose only the contact element 18 is fitted with a hydraulic drive 22 acting in the radial direction relative to the longitudinal axis X. The contact elements 16 and 20 are configured to be rigid in this example, that is, they have a fixed radial length relative to the longitudinal axis X. For bracing the cutting head 2 in the interior of the pipe 4, the hydraulic drive 22 is extended in the axial direction so that the contact element 18 is pressed against the inner wall of the pipe 4. As a reaction, the rigid contact elements 18 and 20 are also pressed accordingly against the inner wall of the pipe. The contact elements 16 and 20 are preferably exchangeable so that contact elements 16, 20 of different radial length can be attached to the cutting head 2 to achieve an adaptation to different pipe diameters. In the alternative embodiment shown in FIG. 3, all three contact elements 16, 18, 20 are provided with a corresponding hydraulic drive 22 where all three hydraulic drives are driven radially outwards for bracing. With a uniform movement of the three hydraulic drives of the three contact elements 16, 18, 20, a centering of the cutting head 2 is made possible in the interior of the pipe 4.

Figure 4:
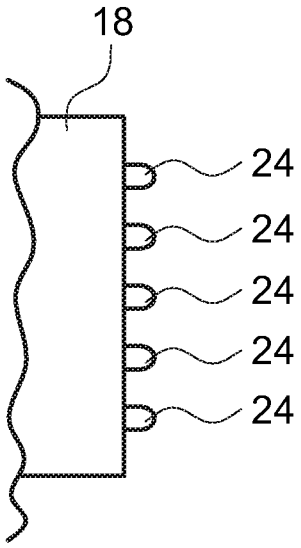
FIG. 4 is an enlarged detail view showing a system element according to FIGS. 1 to 3.

As shown in the enlarged view according to FIG. 4, the contact elements 16, 18, 20 can additionally have engagement elements 24 on their surface facing the inner wall of the pipe 4, that is directed radially outwards, which are shown here, for example, in the form of prongs. These engagement elements 24 provide for a positive engagement in the inner wall of the pipe 4 and for a better fixing of the cutting head in the pipe 4. It should be understood that the contact elements 16 and 20 can be configured in a corresponding manner.

The shown cutting system furthermore has a cutting monitoring device. This comprises an evaluation or control unit 26 which is provided, like the supply unit 8, for arrangement outside the pipe 4. The control unit 26 can be integrated in the supply unit 8. Preferably the control device 26 also controls the supply unit 8 and the complete cutting process, that is also the movement of the nozzle head 10 to form the cut in the pipe wall of the pipe 4. Furthermore, the control unit 26 can also control the actuation of the hydraulic drive 22 for bracing the cutting head 2 in the pipe 4. The control unit 26 is connected via a line connection 28 to the cutting head 2. This can be an electrical or, for example, also an optical connection which allows a transfer of data from the control unit 26 to the cutting head 2 and in the converse direction. The line connection 28 can be integrated with the pressure line 8 into one line.

The cutting monitoring device has four different sensors in the cutting head 2. This is on the one hand a hydrophone 30 which is disposed on an outer wall of the cutting head 2 close to the nozzle head 10 and the cutting nozzle 12. This hydrophone 30 detects noise in the liquid which is located in the interior of the pipe 4 during the cutting process. This is in particular liquid emerging from the cutting nozzle 12, that is preferably water. On the other hand, a pressure sensor 32 is disposed on the outer side of the cutting head 2 also in contact with the liquid in the pipe 4. This records the water pressure in the interior of the pipe 4 during the cutting process.

Furthermore, two sensors are provided in the contact element 18 which come in direct contact with the inner wall of the pipe 4 when the contact element 18 is brought in contact with the inner wall of the pipe 4. These are an acoustic emission sensor 34 and an acceleration sensor 36 which are shown here as two separate sensors, but can also be combined in an integrated sensor. The acceleration sensor 36 is preferably configured as a multi-axial, particularly preferably as a tri-axial acceleration sensor. When bracing the cutting head 2 in the interior of the pipe 4, the acceleration sensor 36 is thus brought into a fixed positioning relative to the pipe 4 so that it can detect movements and accelerations of the pipe 4. The acoustic emission sensor 34 detects vibrations in the pipe, in particular those vibrations which are caused by the cutting jet 14. In particular, the vibrations change when the ambient conditions change, i.e. for example, the pipe wall is completely penetrated, the pipe wall is completely separated or cut through etc. The various states can be recognized from the change in the vibrations.

In this example, the pipe 4 is configured to be three-shelled, that is, it comprises three metal pipes 38, 40 and 42 disposed inside one another, where the metal pipe 42 forms the inner wall of the pipe 4 and the metal pipe 38 forms the outer wall of the pipe 4. The free spaces between the pipe 38 and 40 as well as the pipe 40 and 42 are each filled with concrete 44. In the example shown here, the metal pipes 38, 40, 42 are arranged concentrically with respect to one another about the longitudinal axis X and the free spaces are completely filled with concrete 44. It is to be understood however that in practice, the metal pipes 38, 40, 42 can also be arranged non-concentrically with respect to one another and the free spaces can optionally not be completely filled with concrete 44. It can thus be the case that the pipe 4 has a varying wall thickness over the circumference and different consistency of the pipe wall. This makes the monitoring of the cutting process difficult, where this is possible by combining the signals from the four sensors, that is the hydrophone 30, the pressure sensor 32, the acoustic emission sensor 34 and the acceleration sensor 36 in combination. The control unit 26 evaluates the sensor signals in combination.

The cutting process and the cutting monitoring in this case takes place as follows. After inserting the cutting head 2 into the pipe in a desired axial position along the longitudinal axis X, the cutting head 2 is fixed in the pipe 4 by extending the hydraulic drive or drives 22. After fixing, the cutting process is started by initially starting the high-pressure water supply and then the abrasive agent supply via the supply unit 8. This process can particularly preferably be monitored by the hydrophone 30. From the noise in the water which fills the interior of the pipe 4, it can be detected whether only water or a water-abrasive agent mixture is emerging from the cutting nozzle 12. When the emergence of the water-abrasive agent mixture is detected, the cutting process begins, where the nozzle head 10 is initially not turned until the cutting jet 14 has completely penetrated the pipe wall, that is, has penetrated completely through the metal pipes 38, 40 and 42 as well as the concrete 44 in the intermediate spaces. This can be detected by means of the acoustic emission sensor 34, with the signal of the hydrophone 30 and the pressure sensor 32 being used at the same time. The signals are evaluated in combination. Thus, for example, the pressure sensor 32 detects a pressure drop in the interior of the pipe 4 and the acoustic emission sensor 34 and the hydrophone 30 must detect, for example, a change of the vibration pattern which it has detected, so that the control unit 26 can conclude from this that the pipe wall of the pipe 4 has been completely cut through. The signal of the pressure sensor 32 alone, for example, would not be sufficient since, after cutting through of the inner metal pipe 42, when for example the free space between the metal pipes 40 and 42 is not completely filled, a pressure drop can already occur without the pipe wall being completely cut through. Conversely, for example, a complete cutting-through of the pipe wall can be concluded from a signal change of the hydrophone 30 and the acoustic emission sensor 34 alone, even when a pressure drop does not occur in the interior of the pipe 4. This can be the case, for example when the outer metal pipe 42 is surrounded by a dense material so that even when the outer metal pipe 38 is completely cut through, this does not result in a pressure drop in the interior of the pipe 4. After completely cutting through the pipe wall of the pipe 4 at a circumferential position, the nozzle head 10 is set in motion where it executes a rotation through 360°. The rotational movement is executed slowly in such a manner that the cutting jet 14 always cuts through the total wall thickness of the pipe 4. This is monitored by monitoring the sensors signals of the four said sensors in combination. The rotational speed can be varied in this case by the control unit. For example, the rotational speed can be slowed when regions having thicker wall thickness are reached. A no longer complete cutting-through of the pipe wall is in turn detected from a variation of the signals of the sensors, in particular the vibration signal of the hydrophone 30 and the acoustic emission sensor 34. In particular, an automatic control of the rotation or rotational speed of the nozzle head 10 as a function of the detected sensor signals is possible. The rotational movement or rotational speed is regulated in this case so that the speed of advance is executed as rapidly as possible but as slowly as necessary to ensure a complete penetration of the pipe wall. The complete cutting-through of the pipe can in turn be detected in particular with the assistance of the acceleration sensor 36. When the pipe wall is completely cut through, this can result in a movement of the separated part of the pipe 4 in which the cutting head 2 is fixed, where this movement is detected by the acceleration sensor 36, since this is firmly connected to the pipe 4 via the cutting head 2.

Thus a more reliable detection of the complete cutting-through of the pipe wall can be achieved through the combined evaluation of the sensor signals.

While specific embodiments of the invention have been shown and described in detail to illustrate the application of the principles of the invention, it will be understood that the invention may be embodied otherwise without departing from such principles.

The invention claimed is:

1. A water-abrasive cutting system comprising:

a cutting head which comprises a fixing device for fixing the cutting head on the wall to be cut and a nozzle head disposed on the cutting head, in which at least one cutting nozzle for application of a cutting jet is disposed; and a cutting monitoring device which comprises at least one hydrophone and at least one further sensor and is configured to detect a complete penetration or cutting-through of the wall on the basis of sensor signals of the hydrophone and the at least one further sensor, the hydrophone being disposed on an outer side of the cutting head such that the hydrophone can come in contact with a liquid surrounding the cutting head, the further sensor measuring a characteristic different from a characteristic measured by the hydrophone.

2. The water-abrasive cutting system according to claim 1, wherein the cutting system is configured for cutting pipes and the cutting head is configured for insertion into a pipe or for arrangement on an outer circumference of the pipe.

3. The water-abrasive cutting system according to claim 1, wherein the nozzle head is disposed rotatably on the cutting head.

4. The water-abrasive cutting system according to claim 1, wherein the at least one further sensor is at least one acoustic emission sensor or at least one acceleration sensor or at least one pressure sensor or any combination of at least one acoustic emission sensor and at least one acceleration sensor and at least one pressure sensor.

5. The water-abrasive cutting system according to claim 4, wherein the at least one further sensor is a combination of an acceleration sensor and an acoustic emission sensor, wherein the acceleration sensor and the acoustic emission sensor are configured as an integrated acoustic emission acceleration sensor.

6. The water-abrasive cutting system according to claim 4, wherein the at least one further sensor is a combination of an acceleration sensor and an acoustic emission sensor, wherein the acceleration sensor and the acoustic emission sensor are arranged on the cutting head such that the acceleration sensor and the acoustic emission sensor can be brought into a vibration-transmitting communication with a wall to be cut.

7. The water-abrasive cutting system according to claim 4, wherein the at least one further sensor is a combination of an acceleration sensor and an acoustic emission sensor, wherein the acceleration sensor and the acoustic emission sensor are disposed in a contact element of the fixing device which is provided for contact against the wall.

8. The water-abrasive cutting system according to claim 4, wherein the at least one further sensor is an acceleration sensor, wherein the acceleration sensor is a 3D acceleration sensor.

9. The water-abrasive cutting system according to claim 4, wherein the at least one further sensor is a pressure sensor, wherein the pressure sensor is disposed on the cutting head such that the pressure sensor can detect the pressure of a liquid surrounding the cutting head.

10. The water-abrasive cutting system according to claim 3 wherein the fixing device comprises three contact elements distributed over a circumference of the cutting head, which can come in contact with a pipe wall for fixing.

11. The water-abrasive cutting system according to claim 10, wherein one of the contact elements is movable in a radial direction.

12. The water-abrasive cutting system according to claim 10, wherein two of the contact elements are configured to be rigid in a radial direction and are fastened exchangeably on the cutting head.

13. The water-abrasive cutting system according to claim 10, wherein at least one of the contact elements comprises engagement means on a surface provided for contact with the pipe wall, for positive engagement in the pipe wall.

14. The water-abrasive cutting system according to claim 4, wherein the at least one further sensor is an acceleration sensor, wherein the cutting monitoring device is configured such that the cutting monitoring device detects a cutting-through of the wall of a pipe from an increase in accelerations detected by the acceleration sensor.

15. The water-abrasive cutting system according to claim 1, wherein the cutting monitoring device is configured such that the cutting monitoring device detects that the cutting jet contains abrasive agent from a change in the sensor signal of the hydrophone.

16. The water-abrasive cutting system according to claim 4, wherein the at least one further sensor is a combination of a pressure sensor and an acoustic emission sensor, wherein the cutting monitoring device is configured such that the cutting monitoring device detects a piercing of the wall from a reduction of the pressure detected by the pressure sensor, a change in the sensor signal of the acoustic emission sensor, or from both a reduction of the pressure detected by the pressure sensor and a change in the sensor signal of the acoustic emission sensor.

17. The water-abrasive cutting system according to claim 1, wherein the cutting monitoring device cooperates with a control device for controlling a drive of the nozzle head in such a manner that an advance movement of the nozzle head is controlled as a function of a signal of the cutting monitoring device.

18. A water-abrasive cutting system for cutting in a liquid environment, the system comprising:

a cutting head including a fixing device for fixing the cutting head on a wall to be cut, a nozzle head disposed on the cutting head, in which at least one cutting nozzle for application of a cutting jet is disposed, the cutting head being configured to operate in a liquid of the liquid environment, the liquid surrounding the cutting head during a cutting process; and a cutting monitoring device including a hydrophone and a further sensor, the cutting monitoring device with the hydrophone and the further sensor being configured to detect complete penetration or cutting-through of the wall on the basis of sensor signals of the hydrophone and the further sensor, the hydrophone being arranged on the cutting head and configured to be in contact with the liquid surrounding the cutting head during the cutting process, the further sensor measuring a characteristic different from a characteristic measured by the hydrophone.

19. The water-abrasive cutting system according to claim 18, further comprising:

a control unit receiving sensor signals from the hydrophone and the further sensor, the control unit being configured to evaluate the sensor signals in combination to determine cutting through of the wall, said control unit controlling the cutting head based on the sensor signals.

* * * * *